US007926550B2

(12) United States Patent
Blejde et al.

(10) Patent No.: US 7,926,550 B2
(45) Date of Patent: Apr. 19, 2011

(54) CASTING DELIVERY NOZZLE WITH INSERT

(75) Inventors: Walter N. Blejde, Brownsburg, IN (US); Mike Schueren, Crawfordsville, IN (US); David J. Sosinsky, Carmel, IN (US); Brian D. White, New Market, IN (US); Mark Schlichting, Crawfordsville, IN (US); W. Kent Cooper, Greencastle, IN (US); James Leacock McIntosh, Mason, OH (US); Peter Woodberry, Austinmer (AU); Rama B. Mahapatra, Brighton-Le-Sands (AU); Malcolm McDonald, Hartselle, AL (US)

(73) Assignee: Nucor Corporation

( * ) Notice: Subject to any disclaimer, the term of this patent is extended or adjusted under 35 U.S.C. 154(b) by 351 days.

(21) Appl. No.: 12/131,465

(22) Filed: Jun. 2, 2008

(65) Prior Publication Data

US 2008/0264599 A1 Oct. 30, 2008

Related U.S. Application Data

(63) Continuation-in-part of application No. 12/013,791, filed on Jan. 14, 2008.

(60) Provisional application No. 60/885,778, filed on Jan. 19, 2007.

(51) Int. Cl.
*B22D 11/06* (2006.01)
*B22D 11/10* (2006.01)
*B22D 41/50* (2006.01)

(52) U.S. Cl. ..... 164/480; 164/428; 164/437; 164/488; 222/607

(58) Field of Classification Search ..... 164/480, 164/428, 437, 488; 222/606, 607
See application file for complete search history.

(56) References Cited

U.S. PATENT DOCUMENTS 3,991,815 A 11/1976 Fastner et al.
4,487,251 A 12/1984 Cahoon et al.
5,221,511 A 6/1993 Fukase et al.

(Continued)

FOREIGN PATENT DOCUMENTS

AU 8036691 A 1/1992

(Continued)

OTHER PUBLICATIONS

International Search Report in PCT/AU2008/001046, dated Sep. 30, 2008.

(Continued)

*Primary Examiner* — Kevin P Kerns
(74) *Attorney, Agent, or Firm* — Hahn Loeser & Parks

(57) ABSTRACT

A metal strip casting apparatus and a method of casting continuous metal strip includes assembling a pair of counter-rotatable casting rolls having casting surfaces positioned laterally forming a nip between for casting, and delivering molten metal through a delivery nozzle disposed above the nip capable to form a casting pool supported on the casting rolls. The delivery nozzle comprises segments each having elongate nozzle body with longitudinally extending side walls, end walls and a bottom part to form an inner trough, a nozzle insert disposed above bottom portions of the inner trough of each segment and supported relative to the nozzle body through which incoming molten metal may be delivered to the inner trough of each segment of the delivery nozzle, and the elongate nozzle body of each segment having passageways in fluid communication with the inner trough and outlet openings capable of discharging molten metal from the nozzle body outwardly into the casting pool.

15 Claims, 7 Drawing Sheets

U.S. PATENT DOCUMENTS

| | | | | |
|---|---|---|---|---|
| 5,227,078 | A | 7/1993 | Augustine | |
| 5,402,993 | A | 4/1995 | Hofmann et al. | |
| 5,691,061 | A | 11/1997 | Hanse et al. | |
| 5,716,538 | A | 2/1998 | Poloni et al. | |
| 5,785,880 | A | 7/1998 | Heaslip et al. | |
| 5,840,206 | A | 11/1998 | Gacher et al. | |
| 5,857,514 | A | 1/1999 | Shook et al. | |
| 5,944,261 | A | 8/1999 | Heaslip et al. | |
| 5,958,280 | A | 9/1999 | Reichelt et al. | |
| 6,012,508 | A | 1/2000 | Folder | |
| 6,016,941 | A | 1/2000 | Damle | |
| 6,027,051 | A | 2/2000 | Heaslip et al. | |
| 6,125,917 | A | 10/2000 | Cassar et al. | |
| 6,220,335 | B1 | 4/2001 | Folder et al. | |
| 6,279,790 | B1 | 8/2001 | Nomura et al. | |
| 6,410,469 | B1 | 6/2002 | Hoover et al. | |
| 6,425,505 | B1 | 7/2002 | Heaslip et al. | |
| 6,464,154 | B1 | 10/2002 | Heaslip et al. | |
| 6,586,355 | B2 | 7/2003 | Hoover et al. | |
| 6,932,250 | B2 | 8/2005 | Bederka | |
| 7,063,242 | B2 | 6/2006 | Marti et al. | |
| 2004/0041311 | A1* | 3/2004 | Marti et al. | 266/236 |
| 2005/0211411 | A1* | 9/2005 | Fukase et al. | 164/480 |
| 2008/0173424 | A1* | 7/2008 | Cooper et al. | 164/463 |

FOREIGN PATENT DOCUMENTS

| | | | |
|---|---|---|---|
| EP | 0 850 712 | B1 | 5/2001 |
| WO | 2005/077570 | A1 | 8/2005 |
| WO | 2007/056801 | A1 | 5/2007 |
| WO | 2007/087686 | A1 | 8/2007 |
| WO | 2008/086580 | A1 | 7/2008 |

OTHER PUBLICATIONS

Written Opinion in PCT/AU2008/001046, dated Sep. 30, 2008.

PCT/AU2008/000064 International Search Report.

PCT/AU2008/000064 Written Opinion.

* cited by examiner

CASTING DELIVERY NOZZLE WITH INSERT

CROSS-REFERENCE TO RELATED APPLICATIONS

This application is a continuation-in-part of U.S. Patent Application Ser. No. 12/013,791, filed Jan. 14, 2008, which claims priority from U.S. Provisional Application No. 60/885,778, filed Jan. 19, 2007. The disclosures of both applications are incorporated herein by reference.

BACKGROUND AND SUMMARY

This invention relates to making thin strip and more particularly casting of thin strip by a twin roll caster.

It is known to cast metal strip by continuous casting in a twin roll caster. Molten metal is introduced between a pair of counter-rotating horizontal casting rolls which are cooled so that metal shells solidify on the moving roll surfaces, and are brought together at the nip between them to produce a solidified strip product delivered downwardly from the nip between the rolls. The term "nip" is used herein to refer to the general region at which the rolls are closest together. The molten metal may be poured from a ladle into a smaller vessel or tundish/distributor, from which it flows through a metal delivery nozzle located above the nip, which directs the molten metal to form a casting pool supported on the casting surfaces of the rolls above the nip. This casting pool is typically confined at the ends of the casting rolls by side plates or dams held in sliding engagement adjacent the ends of the casting rolls.

In casting thin strip by twin roll casting, the metal delivery nozzles receive molten metal from the movable tundish and deposit the molten metal in the casting pool in a desired flow pattern. Previously, various designs have been proposed for delivery nozzles involving a lower portion submerged in the casting pool during a casting campaign, and having side openings through which the molten metal is capable of flowing laterally into the casting pool outwardly toward the casting surfaces of the rolls. Examples of such metal delivery nozzles are disclosed in Japanese Patent No. 09-103855 and U.S. Pat. No. 6,012,508. In prior art metal delivery nozzles, there has been a tendency to produce thin cast strip that contains surface defects and associated microcracking from uneven solidification at the chilled casting surfaces of the rolls.

The present invention provides an apparatus and method for continuous thin strip casting that is capable of substantially reducing and inhibiting such surface defects and microcracks in the cast strip, and at the same time reducing wear in the delivery nozzles and the costs in thin strip casting. By testing, we have found that a major cause of such defects is premature solidification of molten metal in the regions where the casting pool meets the casting surfaces of the rolls, generally known as the "meniscus" or "meniscus regions" of the casting pool. In these regions, if solidification occurs before the molten metal has made contact with the roll surface, irregular initial heat transfer can occur between the metal shell and the casting rolls, resulting in formation of surface defects, such as depressions, ripple marks, cold shuts and/or microcracks. The temperature of the metal in the surface region of the casting pool between the rolls tends to be lower than that in the incoming molten metal. If the temperature of the molten metal at the pool surface in the region of the meniscus becomes too low then surface cracks and "meniscus marks" (i.e., marks on the strip caused by the meniscus freezing while the pool level is uneven) are likely to occur One way of dealing with such surface cracks and meniscus marks has been to increase the temperature of the incoming molten metal from the delivery nozzle, so that molten metal reaches the casting surfaces of the casting rolls before reaching solidification temperatures. Another approach has been to cause the incoming molten metal to be delivered relatively rapidly into the meniscus regions of the casting pool directly from the delivery nozzle. This reduced the tendency for premature solidification of the metal before it contacts the casting roll surfaces. This approach has been more effective in reducing surface defects in the cast strip. Examples of this approach are to be seen in Australian Patent Application 60773/96. This approach has allowed for casting of thin strip with reduced formation of surface defects and cracks.

Nevertheless, the formation of pieces of solid metal known as "skulls" in the casting pool in the vicinity of the confining side plates or dams have been observed. The rate of heat loss from the casting pool is higher near the side dams (called the "triple point region") due to conductive heat transfer through the side dams to the casting roll ends. This localized heat loss near the side dams has a tendency to form "skulls" of solid metal in that region, which can grow to a considerable size and fall between the casting rolls and causing defects in the cast strip. An increased flow of molten metal to these "triple point" regions, the regions near the side dams, have been provided by separate direct flows of molten metal to these triple point regions. Examples of such proposals may be seen in U.S. Pat. No. 4,694,887 and in U.S. Pat. No. 5,221,511. Increased heat input to these triple point regions has inhibited formation of skulls.

Australian Patent Application 60773/96 discloses a method and apparatus in which molten metal is delivered to the delivery nozzle in a trough closed at the bottom. Side openings are provided through which the molten metal flows laterally from the nozzle into a casting pool in the vicinity of the casting pool surface. The flow of molten metal into the casting pool was improved; however, unevenness in metal flow adjacent the casting roll surfaces still tended to cause surface defects and surface cracks in the cast strip. Further, there remained concern for wear on the delivery nozzle caused by the impact of the molten metal due to ferrostatic pressure, and turbulence caused as the molten metal moved through the delivery nozzle to discharge laterally into the casting pool below the meniscus of the casting pool. In addition, there was concern for extending the useful life of the delivery nozzles and in turn reducing the cost of producing thin cast strip.

The present invention provides an improved apparatus for casting metal strip and method of continuously casting metal strip. Disclosed is an apparatus for casting metal strip comprising:

(a) a pair of counter-rotatable casting rolls having casting surfaces laterally positioned to form a nip therebetween through which cast strip can be cast, and on which a casting pool of molten metal can be formed supported on the casting surfaces above the nip with side dams adjacent ends at casting rolls to confine the casting pool, (b) a delivery nozzle disposed above the nip capable of delivering molten metal to form the casting pool supported on the casting rolls, the delivery nozzle comprising:

segments each having an elongate nozzle body with longitudinally extending side walls, end walls and a bottom part to form an inner trough, a nozzle insert disposed above bottom portions of the inner trough of each segment and supported relative to the nozzle body and through which incoming molten metal may be delivered to the inner trough of each segment of the delivery nozzle, and the elongate nozzle body of each segment having passageways in fluid communication with the inner trough and outlet openings capable of discharging molten metal from the nozzle body outwardly into the casting pool.

(c) a distributor capable of supplying molten metal to form the casting pool through the nozzle insert, inner trough and passageways of the segments of the delivery nozzle.

The nozzle insert may be positioned to at least partially protect inlets of passageways of the delivery nozzle from the impact of incoming molten metal from the metal distributor. In addition, the nozzle insert may include an end wall acting as a weir to separate the flow of molten metal between the inner trough and a nozzle end portion, where the nozzle end portion is capable of supplying molten metal adjacent an end portion of the casting surfaces of the casting rolls. Further, the nozzle insert may include side walls each having a transition surface from a substantially horizontal orientation to a substantially vertical orientation.

The nozzle insert may also be capable of being placed in the relation to the segments of the delivery nozzle as desired. Also, the nozzle insert may be funnel shaped and extend above the nozzle body of each segment of the delivery nozzle, to further inhibit streaming molten metal from the metal distributor bypassing the inner trough of the segments of the deliver nozzle and entering the casting pool.

Each nozzle insert may be supported relative to the nozzle body by the side walls. Alternatively or in addition, at least one support member may be disposed between the nozzle insert and a bottom portion of the inner trough for supporting the nozzle insert spaced from the bottom portion.

Each segment may be assembled with opposing side walls and an inner trough extending along the side walls to form a shoulder portion between the side walls and the inner trough, and with a plurality of holes extending through each shoulder portion and communicating with side outlets adjacent bottom portions of the segments of the delivery nozzle. By this arrangement, molten metal is capable of flowing into the inner trough, from the inner trough through the holes between the inner trough and sidewalls, and exit the delivery nozzle through the side outlets in a substantially lateral direction into a casting pool. In this embodiment, the bottom of the inner trough may be co-extensive with the entry to the holes into the shoulder portion, and the outlet openings may be spaced longitudinally along the side walls adjacent the bottom part. Each segment may be made in one integral refractory piece, and the nozzle insert may be made in one or more refractory pieces fitted into each segment of the delivery nozzle.

Alternatively, each segment of the metal delivery nozzle may be assembled with at least one partition extending between the side walls, and with the passages between the inner trough and side walls extending between the partitions or between a partition and end wall. In this embodiment, the nozzle inserts may be separately positioned between partitions and end walls portioned by the side walls, or formed as one unit to be positioned above partitions between end walls or formed between and/or over partitions. If desired, in this embodiment, each segment may be made in one integral refractory piece, and the nozzle insert made in one or more refractory pieces fitted into each segment of the delivery nozzle.

In still another embodiment, each segment of the metal delivery nozzle may be assembled with the inner trough and side walls in separate pieces, pinned together with ceramic pins. Protrusions may extend into the passages from the inner trough or side wall, or both, to direct the molten metal flowing through the passages. The protrusions may be in rows aligned or offset as desired to provide the desire flow characteristics to the molten metal as it flows through the passages from the inner trough to the outlet openings adjacent the bottom part of the segment of the delivery nozzle.

Also disclosed is a method of continuously casting metal strip comprised of the steps of:

(a) assembling a pair of counter-rotatable casting rolls having casting surfaces laterally positioned to form a nip therebetween through which cast strip can be cast, (b) assembling segments of a delivery nozzle above the nip with each segment having an elongate nozzle body including longitudinally extending side walls, end walls and a bottom part to form a nozzle trough in the nozzle body and having passageways in fluid communication between the nozzle trough and outlet opening capable of discharging molten metal from the nozzle body laterally into the casting pool, (c) assembling a nozzle insert above the trough of each segment of the delivery nozzle to withstanding a part of the impact of the incoming molten metal and at least partially protecting the passageways of the delivery nozzle from the impact of incoming molten metal to the segments of the delivery nozzle, (d) forming a casting pool of molten metal on the casting surfaces above the nip, and (e) delivering molten metal from a metal distributor through the nozzle insert, and the nozzle trough and passageways of the delivery nozzle to discharge molten metal laterally into the casting pool.

In this method of continuously casting metal strip, each segment may be assembled with opposing side walls and an inner trough extending along the side walls to form a shoulder portion between the side walls and the inner trough, and with a plurality of holes extending through each shoulder portion and communicating with side outlets adjacent bottom portions of the segments of the delivery nozzle, such that molten metal is capable of flowing into the inner trough, from the inner trough through the holes between the inner trough and sidewalls, and exit the delivery nozzle through the side outlets in a substantially lateral direction into a casting pool. In this embodiment, the bottom of the inner trough is co-extensive with the entry to the holes into the shoulder portion, and the outlet openings may be spaced longitudinally along the side walls adjacent the bottom part. Each segment may be made in one integral refractory piece, and the nozzle insert made in one refractory piece may be fitted into each segment of the delivery nozzle.

Alternatively, in the method of continuously casting metal strip, each segment of the metal delivery nozzle may be assembled with at least one partition extending between the side walls, and with the passages between the inner trough and side walls extending between the partitions or between a partition and end wall. In this embodiment, the nozzle inserts may be separately positioned between partitions and end walls portioned by the side walls, or formed as one unit to be positioned above partitions between end walls or formed over partitions. If desired, in this embodiment, each segment may be made in one integral refractory piece, and the nozzle insert made in one or more refractory pieces fitted into each segment of the delivery nozzle.

In still another embodiment of the method of continuously casting metal strip, each segment of the metal delivery nozzle may be assembled with the inner trough and side walls in separate pieces, pinned together with ceramic pins. Protrusions may extend into the passages from the inner trough or side wall, or both, to direct the molten metal flowing through the passages. The protrusions may be in rows aligned or offset as desired to provide the desire flow characteristics to the molten metal as it flows through the passages from the inner trough to the outlet openings adjacent the bottom part of the segment of the delivery nozzle.

In each embodiment of both the improved delivery nozzle and method of casting steel strip with the delivery nozzle, each segment of the delivery nozzle is provided with a nozzle insert that assists in absorbing the kinetic energy of the molten metal entering the inner trough of the segments of the delivery nozzle, assists in protecting the passageways of the segments of the delivery nozzle from the impact of the molten metal, inhibits splashing and reduces turbulence in the flow of molten metal through the nozzle, and is relatively inexpensive and can be easily replaced. In addition, the inner trough dissipates a substantial part of the kinetic energy present in the molten metal by reason of downward movement through the metal delivery system from the tundish to the metal distributor to the delivery nozzle. The combination of the nozzle insert and inner trough through the passages to the side outlets further reduces the kinetic energy in the molten metal before reaching the casting pool. As a result, a more uniform and more quiescent flow of molten metal is provided to the casting pool to enhance uniform formation of the cast strip.

The nozzle insert also may be replaceable to further extend the useful life of the delivery nozzle.

Various aspects of the invention will be apparent from the following detailed description, drawings and claims.

BRIEF DESCRIPTION OF THE DRAWINGS

The invention is described in more detail in reference to the accompanying drawings in which.

DETAILED DESCRIPTION

Figure 1:
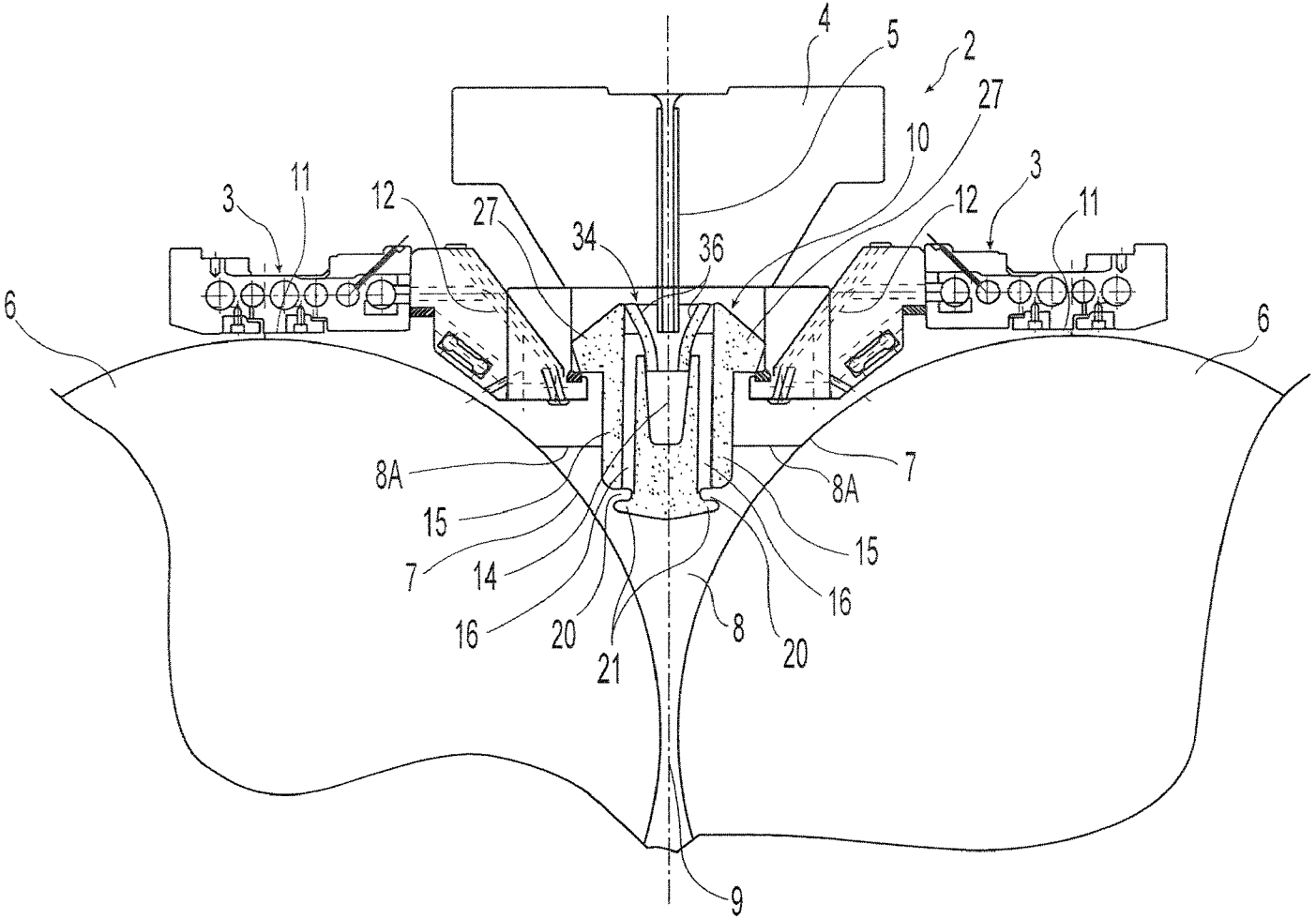
FIG. 1 illustrates a cross-sectional end view of a portion of twin roll strip caster with an assembled metal delivery nozzle.

Referring to FIG. 1, the metal strip casting apparatus 2 includes a metal delivery nozzle 10 formed in segments 13 located below a metal distributor 4 (also called a moveable tundish or transition piece) and above casting rolls 6. Casting rolls 6 are laterally positioned with nip 9 formed between them. Metal distributor 4 receives metal from a ladle through a metal delivery system (not shown) and delivers the molten metal to delivery nozzle 10. A shroud 5 may extend from metal distributor 4 and into delivery nozzle 10, for the purpose of transferring molten metal into the segments of delivery nozzle 10. In the alternative, metal distributor 4 may transfer metal to the segments of delivery nozzle 10 via a hole in the bottom of metal distributor 4. Below delivery nozzle 10, a casting pool 8 having surface 8A is formed supported on the casting surfaces 7 of casting rolls 6 adjacent nip 9. Casting pool 8 is constrained at the ends of the casting rolls by side dams or plates (not shown) positioned against the sides of the casting rolls. The segments 13 of the delivery nozzle 10 controls molten metal flow into casting pool 8. Generally, segments 13 of the delivery nozzle 10 extends into and are partially submerged in casting pool 8 during the casting campaign. Also shown in FIG. 1 is gas control apparatus 3 for maintaining a gas seal 11 with the casting surfaces 7 of casting rolls 6 and maintaining an inert atmosphere of nitrogen and/or argon above the casting pool 8 by blowing such gas through passageways 12 in gas control apparatus 3.

A nozzle insert 34 is shown in FIG. 1 is positioned above and generally within an inner trough 14 of the segments 13, and supported to receive molten metal from the tundish 4 and assist in breaking and redirecting the impact of incoming molten metal to the delivery nozzle. The nozzle insert 34 guides the flow of molten metal to the inner trough 14 of each segment, and through inlets to passages 16, or holes 31, to be discharged through side outlets 20 from the delivery nozzle 10 outwardly to the casting pool 8.

Figure 2:
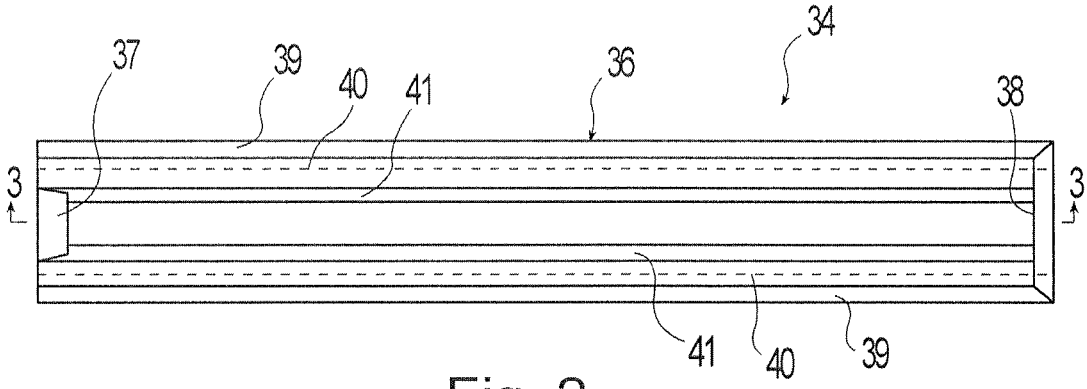
FIG. 2 is an enlarged plan view of a nozzle insert for a segment of a metal delivery nozzle for use in the twin roll caster shown in FIG. 1.
Figure 3:
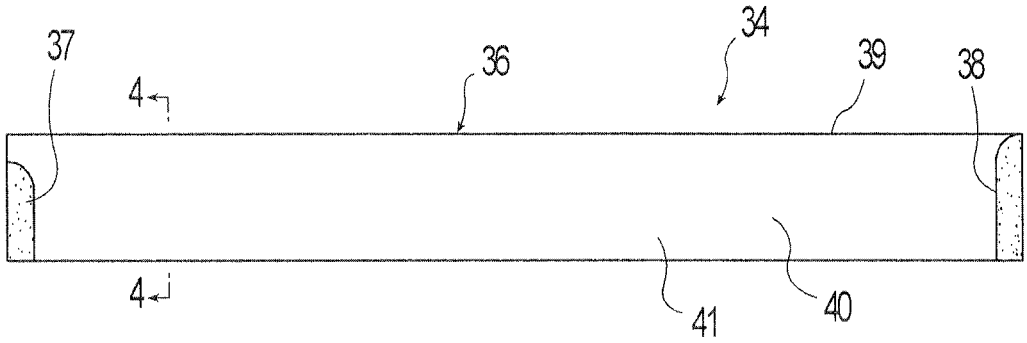
FIG. 3 is an enlarged cross-sectional side view taken along line 3-3 of the nozzle insert for a segment of the metal delivery nozzle shown in FIG. 2
Figure 4:
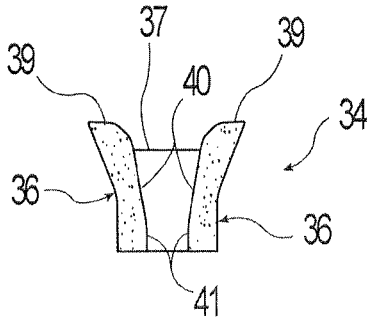
FIG. 4 is an enlarged cross-sectional transverse view taken along line 4-4 of a portion of the segment of the nozzle insert for the metal delivery nozzle shown in FIG. 3.

As best shown in FIGS. 2-4, the nozzle insert 34 has opposing side walls 36, which extend lengthwise along the nozzle insert 34 in the longitudinal direction of nozzle insert 34 and define a channel for the flow of molten metal from the metal distributor 4 to the inner trough 14 of the segment 13. The nozzle insert 34 includes end walls 37 and 38 and is dimensioned to fit with upper parts of segment side walls 15 forming inner trough 14 for support as described below.

Each side wall 36 of each nozzle insert 34 may include an upper surface 39, a transition surface 40, and a lower surface 41. The upper surfaces 39 may be substantially horizontal and the lower surfaces may be substantially vertical with the transition surfaces 40 extending there between in a curved or straight manner as desired. The upper surfaces 39 transversely extend beyond the lower surfaces 41. It is understood, however, that the insert side walls 36 may be formed with an inner surface and need not include separate surfaces 39, 40 and 41. The insert side walls 36 may includes any surface or surface for guiding the flow of molten metal into the segment 13.

Figure 5:
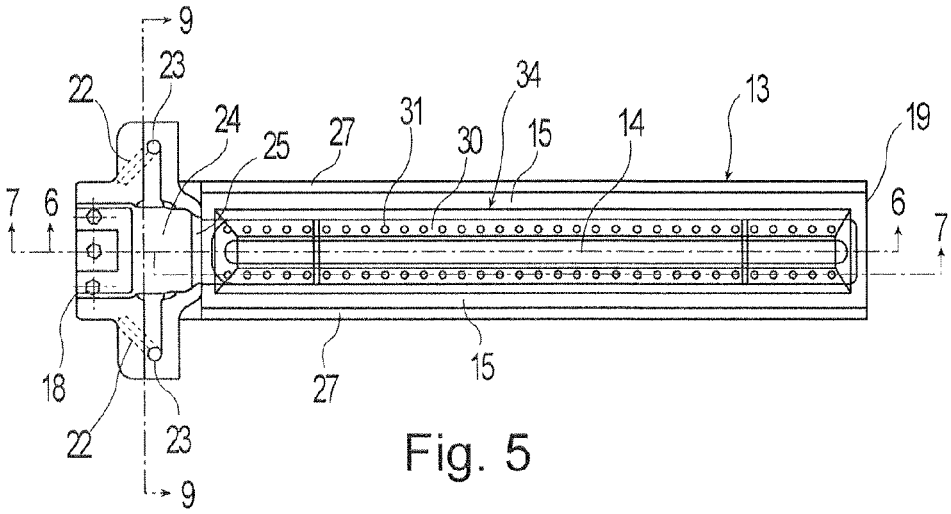
FIG. 5 is a plan view of a segment of a metal delivery nozzle fitted with a nozzle insert for use in a twin roll caster as shown in FIG. 1.
Figure 11:
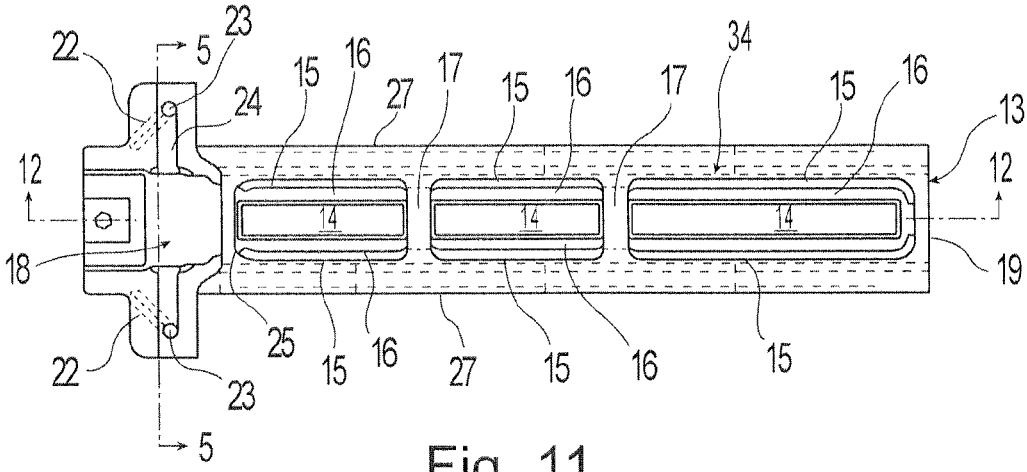
FIG. 11 is a plan view of an alternative segment of metal delivery nozzle for use in the twin roll caster shown in FIG. 1.
Figure 12:
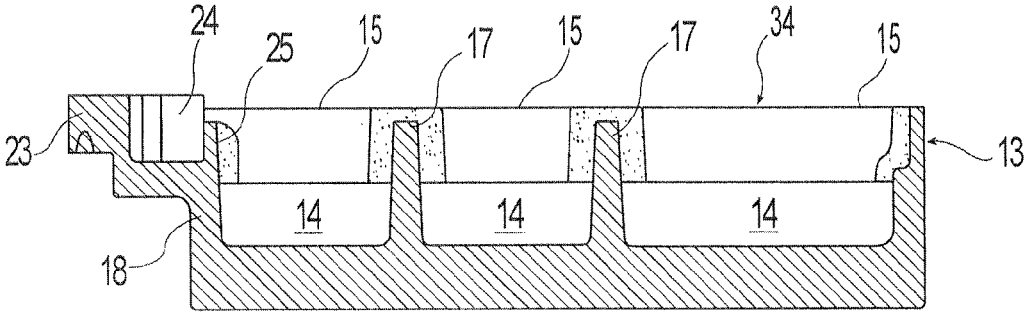
FIG. 12 is a cross-sectional side view taken along line 12-12 of the segment of the metal delivery nozzle shown in FIG. 11.

Referring to FIGS. 5-8, the delivery nozzle 10 is comprised of two segments 13, both similar to the one illustrated in FIG. 5 with segment end walls 19 position adjacent but spaced from each other. The segment side walls 15 are joined to the inner trough 14 to form shoulder portions 30, and the passages 16 in the form of holes 31 extending through the shoulder portion 30 along each side of the inner trough 14. The molten metal flows from the inner trough 14 through the holes 31 to the side outlets 20. The shoulder portion 30 provides the structural support to the segment 13 when the delivery nozzle 10 is loaded with molten metal during a casting campaign. In this embodiment, partitions 17, as shown in the alternative embodiment described below with reference to FIGS. 11-12, are not needed to provide structural support for the segment 13 when loaded with molten metal. As a result, the flow of molten metal from the side outlets 20 into the casting pool 8 can be provided laterally more evenly along each segment 13.

A pair of support members 35 may be placed in the bottom of the inner trough 14. The nozzle insert 34 is then placed above and generally within the inner trough 14 supported by the support members 35 and the segment side walls 15. During the casting process molten metal is then discharged by the metal distributor 4 through the nozzle insert 34 into inner trough 14 of the segments 13 of the delivery nozzle 10. The molten metal flows from the inner trough 14 into the passages 16, or the holes 31, and outwardly through the side outlets 20 adjacent bottom portions of the segment 13 into the casting pool 8 below the meniscus.

In operation, molten metal is poured from the metal distributor 4 through shroud 5 into the inner trough 14 of the segments 13 of the delivery nozzle 10 through the nozzle insert 34. Several shrouds 5 may be provided along the length of the segments 13 of the delivery nozzle 10. The molten metal flows from the inner trough 14 into and through the passages 16 to the side outlets 20. The side outlets 20 direct the flow of molten metal to discharge the molten metal laterally into the casting pool 8 in the direction of the meniscus between the surface 8A of the casting pool 8 and the casting surfaces 7 of the casting rolls 6.

The nozzle insert 34 is disposed above and may be within the inner trough 14. The nozzle insert 34 is supported relative to the segment 13 by the segment side walls 15 and a pair of support members 35. The pair of support members 35 space the nozzle insert 34 apart from the bottom of the inner trough 14 to provide space for the flow of molten metal into the passages 16, while dampening the flow of molten metal in the inner trough 14 of the segments 13 of the delivery nozzle. It must be understood, however, that the nozzle insert 34 may be supported relative to the segment 13 in any suitable manner. The nozzle insert 34 may be supported by portions of the segment 13, supported by any number of support members 35 engaging the segment 13, a combination thereof, or by a separate support from or engaging the segment 13, capable of supporting the nozzle insert 34 relative to the segment 13.

Figure 9:
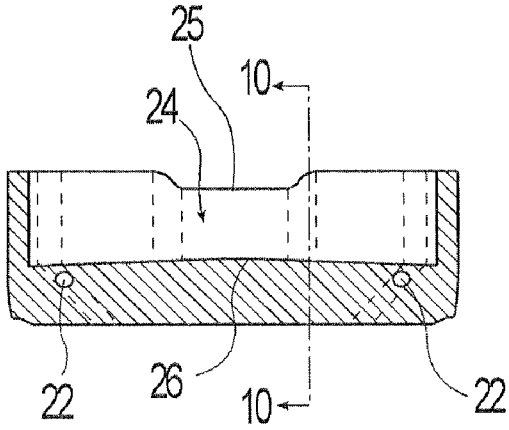
FIG. 9 is a cross-sectional transverse taken along line 9-9 of enlarged section of the triple section of the segment of the metal delivery nozzle shown in FIG. 5.
Figure 10:
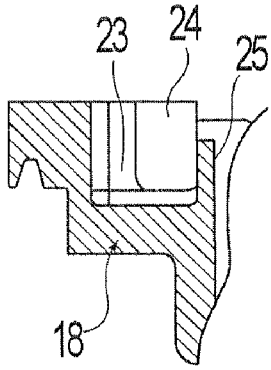
FIG. 10 is a cross-sectional transverse view taken along line 10-10 of the segment of the metal delivery nozzle shown in FIG. 9.

Referring to FIGS. 9-10, the assembly of the segment end portion 18 of the segment 13 positioned adjacent one of the ends of the casting rolls 6 is illustrated. This is called the "triple point" region and is the area where skulls are more likely to form because of the different heat gradient adjacent a side dam. To compensate, molten metal is directed into the "triple point" region through slanted passageways 22 through the segment end portion 18 as shown in FIG. 5 through outlets 23 from a reservoir 24, which is positioned transverse to the segment end portion 18 of the segment 13. The shape of the reservoir 24 is shown in FIGS. 9 and 10, with a bottom portion 26 shaped to cause the molten metal to flow toward the outlets 23 and into the slanted passageways 22. A weir 25 is also provided in the segment 13 to separate the flow of molten metal in the reservoir 24 into the "triple point" region, while allowing flow of molten metal from the inner trough 14 currently as the metal flows into the passages 16. The height of the weir 25 is selected to provide most effective flow of molten metal at a higher effective temperature into the "triple point" region to balance the difference in heat gradient in the "triple point" region.

Figure 6:
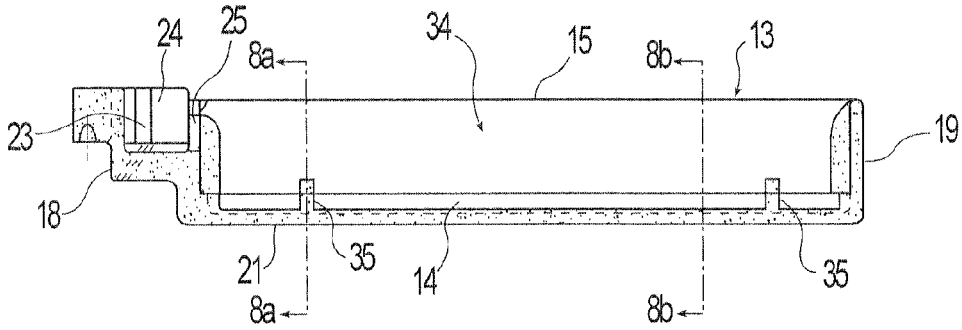
FIG. 6 is a cross-sectional taken along line 6-6 of the segment of the metal delivery nozzle shown in FIG. 5.
Figure 7:
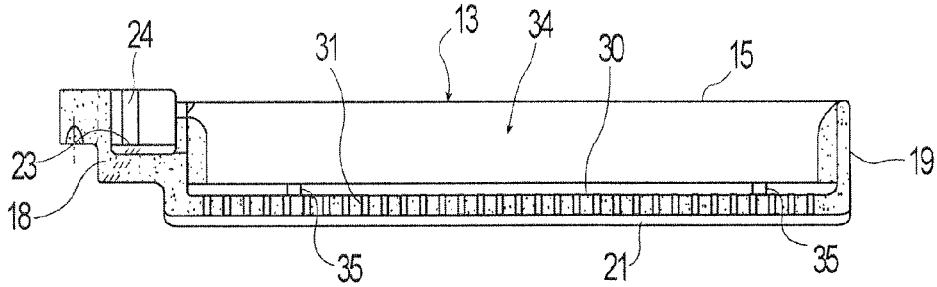
FIG. 7 is a cross-sectional taken along line 7-7 of the segment of the metal delivery nozzle shown in FIG. 5.
Figure 8A:
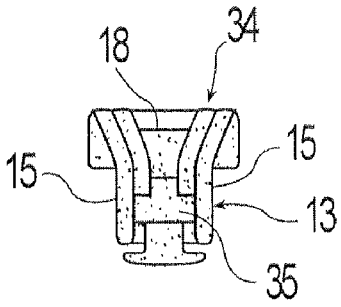
FIG. 8A is a cross-sectional transverse taken along line 8A-8A of the segment of the metal delivery nozzle with the nozzle insert shown in FIG. 6.
Figure 8B:
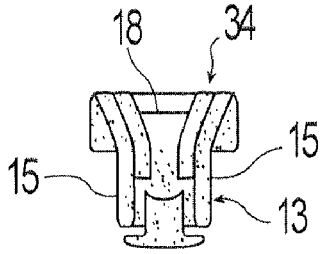
FIG. 8B is a cross-sectional transverse taken along line 8B-8B of the segment of the metal delivery nozzle with the nozzle insert shown in FIG. 6.

The end wall 37 of each nozzle insert 34 may act as a weir to separate the flow of molten metal into the reservoir 24. Thus, it is contemplated that such an arrangement may not include the weir 25, as shown in FIGS. 5-7. In such a case, the height of the insert end wall 37 is selected to provide most effective flow of molten metal at a higher effective temperature into the reservoir 24 and on to the "triple point" region to normalize the difference in heat gradient in the "triple point" region. The nozzle insert 34 may be made of any refractory material, such as alumina graphite, the material of the segment 13 or any other material suitable for guiding the flow of incoming molten metal.

Referring to FIG. 11-12, an alternative embodiment of the delivery nozzle 10 comprises two segments 13 (one shown), with each segment 13 having opposing side walls 15 and an upward opening inner trough 14, which extend lengthwise along segment 13 in the longitudinal direction of delivery nozzle 10. Partitions 17 extend between segment side walls 15 at spaced locations along each segment 13, and provide structural support for the segment 13 of the delivery nozzle 10 when loaded with molten metal in operation. Passages 16 are formed between the segment side walls 15 and inner trough 14. The passages 16 extend between the partitions 17 or between one partition 17 and a segment end portion 18 or a segment end wall 19 along the length of the segment 13. The passages 16 extend to side outlets 20 at a bottom portion 21 of the segment 13.

In each of the embodiments described above, the pair of segments 13 may be assembled lengthwise with the segment end walls 19 in abutting relation and the segment end portions 18 forming the outer ends of delivery nozzle 10. Alternatively, delivery nozzle 10 may comprise a single segment 13, or more than two segments 13, that include all the features of, and effectively functions as, the pair of segments 13 as described herein. Further, segment 13 may include partitions 17, extending between segment side walls 15 to strengthen segment 13 under load of molten metal during a casting campaign. As shown in FIG. 1, each segment 13 includes mounting flanges 27 that extend outward from segment side walls 15, either continuously (as shown in FIG. 11) or intermittently, as desired, to mount segments 13 to assemble the delivery nozzle 10 in the casting apparatus 2. Since the passages 16 and the side outlets 20 extend along both sides of the segments 13, except at the partitions 17, a relatively uniform flow of molten metal can be provided along the length of the segments 13. The nozzle insert 34 can be provided as a single unit above or formed around partitions 17, or provided in parts capable of fitting between partitions 17 or between a partition 17 and an end portion 18. The assembly of the segments 13 of the metal delivery nozzle 10 is otherwise generally the same as that described above with reference to FIGS. 5-10.

Figure 13:
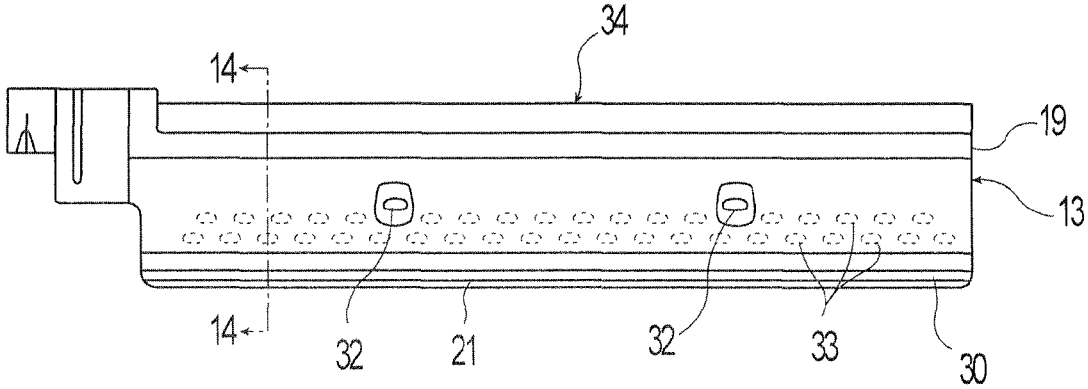
FIG. 13 is a side view of the segment of another alternative segment of a metal delivery nozzle for use in the twin roll caster shown in FIG. 1.
Figure 14:
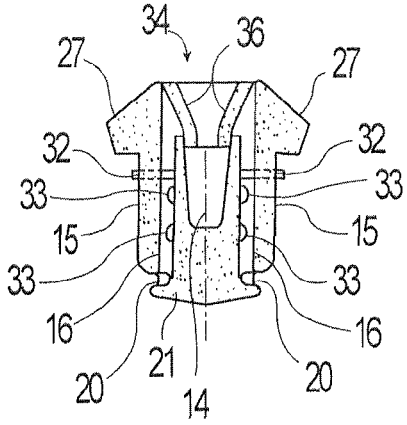
FIG. 14 is a cross-sectional transverse taken along line 14-14 of the segment of the metal delivery nozzle shown in FIG. 13.

Referring to FIGS. 13 and 14, an alternative embodiment each segment 13 of the delivery nozzle 10 is described where each segment 13 is assembled in two pieces, with one piece being the inner trough 14 and the bottom portion 21 as shown in FIG. 14. The other piece includes all of the other parts of the segment 13 as described above with reference to FIGS. 5-10. The two pieces are assembled together by use of ceramic pins 32, which extend through holes on the segment side walls 15 and into or through holes in the side portions of the inner trough 14. The ceramics pins provide structural support for the segments 13 and the delivery nozzle 10 when the delivery nozzle is loaded with molten metal during a casting campaign.

In the embodiment shown FIGS. 13 and 14, two or more offset rows of protrusions 33 are provided in the outside wall of inner trough 14. The protrusions 33 extend into passages 16 to provide a serpentine path to the flow of molten metal through passages 16 to the side outlets 20. Alternatively, some or all of the protrusions 33 may be provided on the inside surface of the segment side walls 15 as desired in the embodiment. In any case, successive rows of the protrusions 33 may be aligned or offset to provide the flow pattern as desired for the molten metal through passages 16. The assembly of the segments 13 of the metal delivery nozzle 10 is otherwise generally the same as that described above with reference to FIGS. 5-10.

Figure 15:
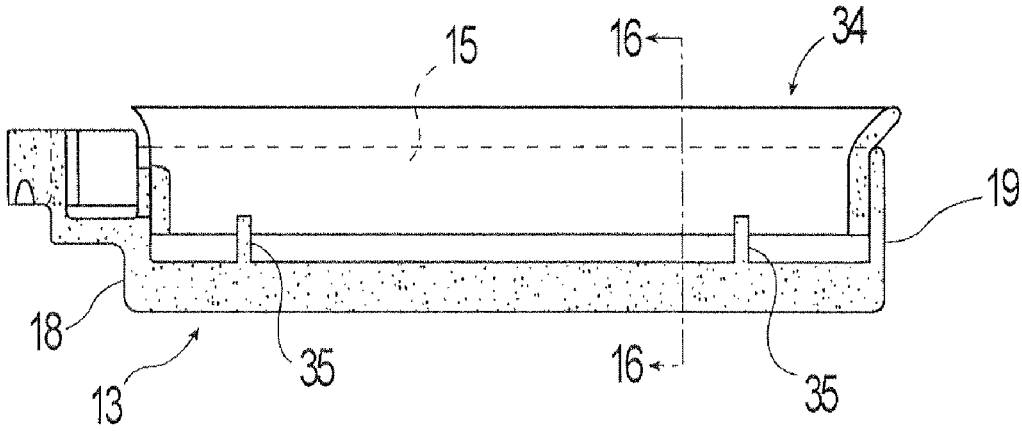
FIG. 15 is a cross-sectional side view of a segment of a metal delivery nozzle for use in a twin roll caster with an alternative nozzle insert.
Figure 16:
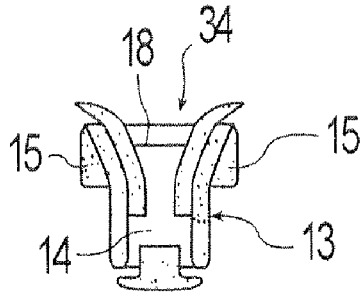
FIG. 16 is a cross-sectional taken along line 16-16 of the segment of the metal delivery nozzle with the nozzle insert shown in FIG. 15.
Figure 17:
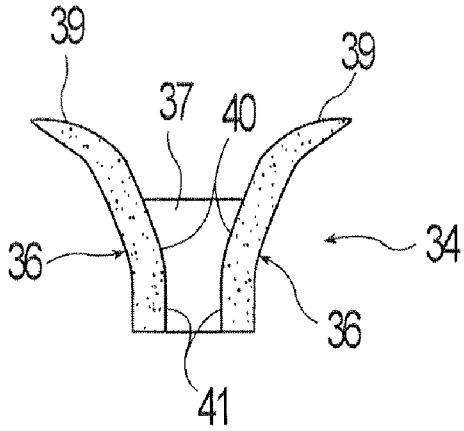
FIG. 17 is an enlarged cross-sectional transverse view of a portion of the segment of the nozzle insert for the metal delivery nozzle shown in FIG. 16.

Referring now to FIGS. 15-17, an alternative embodiment of the delivery nozzle 10 has segment 13 that includes support members 35 to provide structural support for a nozzle insert 34 which assists in directing the molten metal from the metal distributor 4 into the inner trough 14 of the segment 13 of delivery nozzle 10. As used with regards to this embodiment, it must be understood that the inner trough 14 may be any portion of the segment 13 suitable for receiving the flow of molten metal into the segment 13. The segment 13 shown in FIGS. 15-17 is generally the same as that shown in FIGS. 5-10 except as described below. The nozzle insert 34 protects the segment side walls 15 from wear due to the impact of the incoming molten metal, and also protects, at least in part, part of the inlets to the passages 16 from the inner trough 14 of the nozzle from wear from the impact of the incoming molten metal. The nozzle insert 34 thus generally reduces wear of the delivery nozzle 10 from the impact of the incoming molten metal, and also substantially reducing the amount of turbulence and disturbances in flow of molten metal adjacent the inlets to passages 16.

This embodiment of the delivery nozzle 10, including the nozzle insert 34 supported on the segment 13, directs a substantial portion of the incoming flow of molten metal from the metal distributor 4 to a substantially planar bottom inner trough 14 of the delivery nozzle 10, thereby increasing the useful life of the delivery nozzle 10 from the impact of incoming molten metal and substantially reducing the amount of turbulence and disturbances in flow of molten metal adjacent the inlets to passages 16. Further, in this embodiment, the nozzle insert 34 provides for a greater reception area for the flow of molten metal and thus further reduces the impact of the flow upon the segment 13 and reduces the risk for misaligned streams from the flow to cause unintended disturbances in the casting pool 8.

The nozzle insert 34 includes opposing side walls 36 that extend beyond the segment side walls 15 when the nozzle insert 34 is disposed within the segment 13. Additionally, the sidewalls flare beyond the top edges of the segment side walls 15 such that the upper surfaces 39 extends over at least a portion of the top of the segment side walls 15. As shown, the upper surfaces 39 fully extend beyond the segment side walls 15.

The nozzle insert 34 may be generally funnel shaped. Additionally, the upper surfaces 39 open to extend beyond the lower surfaces 41 and extend beyond the transition surfaces 40 to allow for a greater reception area for the flow of molten metal. Further, the curvature of the insert side walls 36 from the upper surface 39 to the transition surface 40 provides a gentler slope to direct the flow of molten metal into the inner trough 14.

It should be understood that the above described apparatus and method of casting thin strip are the presently contemplated best modes of embodying the invention. It is to be understood that these and other embodiments may be made and performed within the scope of the following claims. In each embodiment of the delivery nozzle, the nozzle insert dissipates a substantial part of the kinetic energy built up in the molten metal by reason of movement through the delivery system from the metal distributor to the delivery nozzle, and the resistance to movement of the molten metal from the inner trough through the passages to the side outlets further reduces the kinetic energy in the molten metal from the molten metal before reaching the casting pool. As a result, a more uniform and more quiescent flow of molten metal is provided to the casting pool to formation of the cast strip.

While the principle and mode of operation of this invention have been explained and illustrated with regard to particular embodiments, it must be understood, however, that this invention may be practiced otherwise than as specifically explained and illustrated without departing from its spirit or scope.

What is claimed is:

1. An apparatus for casting metal strip comprising:

(a) a pair of counter-rotatable casting rolls having casting surfaces laterally positioned to form a nip therebetween through which cast strip can be cast, and on which a casting pool of molten metal can be formed supported on the casting surfaces above the nip with side dams adjacent ends at casting rolls to confine the casting pool, (b) a delivery nozzle disposed above the nip capable of delivering molten metal to form the casting pool supported on the casting rolls, the delivery nozzle comprising:

segments each having an elongate nozzle body with longitudinally extending side walls, end walls and a bottom part to form an inner trough, a nozzle insert separate from a shroud of a metal distributor disposed above bottom portions of the inner trough of each segment and supported relative to the nozzle body and through which incoming molten metal may be delivered to the inner trough of the segment of the delivery nozzle, and the elongate nozzle body of each segment having passageways in fluid communication with the inner trough and outlet openings capable of discharging molten metal from the nozzle body outwardly into the casting pool, and (c) a metal distributor capable of supplying molten metal to form the casting pool through the nozzle insert, inner trough and passageways of each segment of the delivery nozzle.

2. The apparatus for casting metal strip as claimed in claim 1 where each nozzle insert is capable of being replaced as desired.

3. The apparatus for casting metal strip as claimed in claim 1 where each nozzle insert is positioned to at least partially protect inlets of passageways of the segments of the delivery nozzle from the impact of incoming molten metal from the metal distributor.

4. The apparatus for casting metal strip as claimed in claim 1 where each nozzle insert is funnel shaped and extends above the nozzle body.

5. The apparatus for casting metal strip as claimed in claim 1 where at least one support member is disposed between the nozzle insert and the bottom part to support the nozzle insert spaced from a bottom portion of the inner trough.

6. The apparatus for casting metal strip as claimed in claim 1 where the nozzle insert is supported relative to the nozzle body by the side walls.

7. The apparatus for casting metal strip as claimed in claim 1 where the outlet openings are spaced longitudinally along the bottom part of the nozzle body.

8. The apparatus for casting metal strip as claimed in claim 1 where the bottom part is an integral part with the side walls.

9. The apparatus for casting metal strip as claimed in claim 1 where the outlet openings are spaced longitudinally along the side walls.

10. The apparatus for casting metal strip as claimed in claim 1 where the nozzle insert includes an end wall acting as a weir to separate the flow of molten metal between the inner trough and a nozzle end portion and the nozzle end portion is capable of supplying molten metal adjacent end portions of the casting surfaces of the casting rolls.

11. The apparatus for casting metal strip as claimed in claim 1 where the nozzle insert includes a side wall having a transition surface from a substantially horizontal orientation to a substantially vertical orientation.

12. A method of continuously casting metal strip comprised of the steps of:

(a) assembling a pair of counter-rotatable casting rolls having casting surfaces laterally positioned to form a nip therebetween through which cast strip can be cast, (b) assembling a delivery nozzle above the nip including segments each having an elongate nozzle body including longitudinally extending side walls, end walls and a bottom part to form a nozzle trough in the nozzle body and having passageways in fluid communication between the nozzle trough and outlet openings capable of discharging molten metal from the nozzle body outwardly into a casting pool, (c) assembling a nozzle insert separate from a shroud of a metal distributor above a trough of the delivery nozzle to withstand a part of the impact of incoming molten metal and at least partially protect the passageways of the delivery nozzle from the impact of incoming molten metal to the delivery nozzle, (d) forming the casting pool of molten metal on the casting surfaces above the nip, and (e) delivering molten metal from a metal distributor through the nozzle insert, and the nozzle trough and passageways of each segment of the delivery nozzle to discharge molten metal laterally into the casting pool.

13. The method of continuously casting metal strip as claimed in claim 12 further comprising the step of:

(f) periodically replacing nozzle inserts during operation of the delivery nozzle.

14. The method of continuously casting metal strip as claimed in claim 12 further comprising the step of:

(f) placing at least one support member between the nozzle insert and the bottom part for supporting the nozzle insert relative to the nozzle body.

15. The method of continuously casting metal strip as claimed in claim 12 where the nozzle insert is funnel shaped and extends above the nozzle body.

* * * * *